US007077444B2

(12) United States Patent
Kaufman et al.

(10) Patent No.: US 7,077,444 B2
(45) Date of Patent: Jul. 18, 2006

(54) TWO HANDLED SHOVEL

(76) Inventors: Gregory Kaufman, 285 St. Mary's Rd., Green Oaks, IL (US) 60048; Uri Ivanovich Semushkin, Shepkina Street 12, Building 1, Apt. 9, Moscow (RU) 129090

( * ) Notice: Subject to any disclaimer, the term of this patent is extended or adjusted under 35 U.S.C. 154(b) by 0 days.

(21) Appl. No.: 10/708,605

(22) Filed: Mar. 15, 2004

(65) Prior Publication Data

US 2005/0200140 A1 Sep. 15, 2005

(51) Int. Cl.
*A01B 1/22* (2006.01)

(52) U.S. Cl. ..... 294/58; 294/54.5

(58) Field of Classification Search ..... 294/58, 294/59, 54.5, 153, 154; 37/285, 270, 271; D8/10; 16/112.1, 400, 408, 426
See application file for complete search history.

(56) References Cited

U.S. PATENT DOCUMENTS

| | | | | | |
|---|---|---|---|---|---|
| 462,043 | A | * | 10/1891 | Gibbs | 294/53.5 |
| 725,905 | A | * | 4/1903 | Willaims | 294/58 |
| 961,656 | A | * | 6/1910 | Stricklin | 294/53.5 |
| 1,182,724 | A | * | 5/1916 | Waldorf | 294/53.5 |
| 1,183,277 | A | * | 5/1916 | Collins | 294/53.5 |
| 1,300,452 | A | * | 4/1919 | Moscherrosch | 294/59 |
| 2,199,072 | A | | 4/1940 | Garabrant | |
| 2,342,436 | A | | 2/1944 | Stuart | |
| 2,666,662 | A | * | 1/1954 | McLeod | 294/55 |
| 2,728,598 | A | * | 12/1955 | Szillage | 294/54.5 |
| 3,082,554 | A | * | 3/1963 | Steeb | 294/54.5 |
| 3,119,596 | A | | 1/1964 | Pratt | |
| 3,436,111 | A | | 4/1969 | England | |
| 3,645,578 | A | | 2/1972 | Renfroe | |
| D269,936 | S | * | 8/1983 | Storlie | 294/58 |
| D270,612 | S | * | 9/1983 | Storlie | 294/58 |
| 4,793,645 | A | | 12/1988 | Decker | |
| 4,881,332 | A | | 11/1989 | Evertsen | |
| 4,944,541 | A | | 7/1990 | Waldschmidt | |
| 5,133,582 | A | | 7/1992 | Rocha | |
| 5,140,767 | A | * | 8/1992 | Traut | 294/53.5 |
| 5,271,169 | A | * | 12/1993 | Konsztowicz | 37/285 |
| 5,411,305 | A | | 5/1995 | Revoldt | |
| 5,447,349 | A | | 9/1995 | Coble | |
| 5,487,577 | A | | 1/1996 | Ball | |
| 5,499,852 | A | | 3/1996 | Seigendall | |
| 5,669,650 | A | | 9/1997 | Rutz | |
| 5,704,672 | A | * | 1/1998 | Sims | 294/58 |
| 5,732,933 | A | | 3/1998 | Champi | |
| 5,871,246 | A | | 2/1999 | Simdom | |
| 5,921,600 | A | | 7/1999 | Lucas | |
| 6,203,081 | B1 | * | 3/2001 | Kegan, Sr. | 294/59 |
| 6,254,154 | B1 | * | 7/2001 | Herzfeld et al. | 294/58 |
| 6,485,076 | B1 | | 11/2002 | Chang | |
| 6,704,968 | B1 | | 3/2004 | Lau | |

* cited by examiner

*Primary Examiner*—Eileen D. Lillis
*Assistant Examiner*—Paul T. Chin
(74) *Attorney, Agent, or Firm*—Clausen Miller, P.C.

(57) ABSTRACT

A two handled shovel for clearing a surface, the shovel comprising a blade having a leading edge which contacts the surface, a main handle attached to the blade, and an auxiliary handle pivotally attached to the blade near the leading edge. The shovel may be used by one or two users.

2 Claims, 5 Drawing Sheets

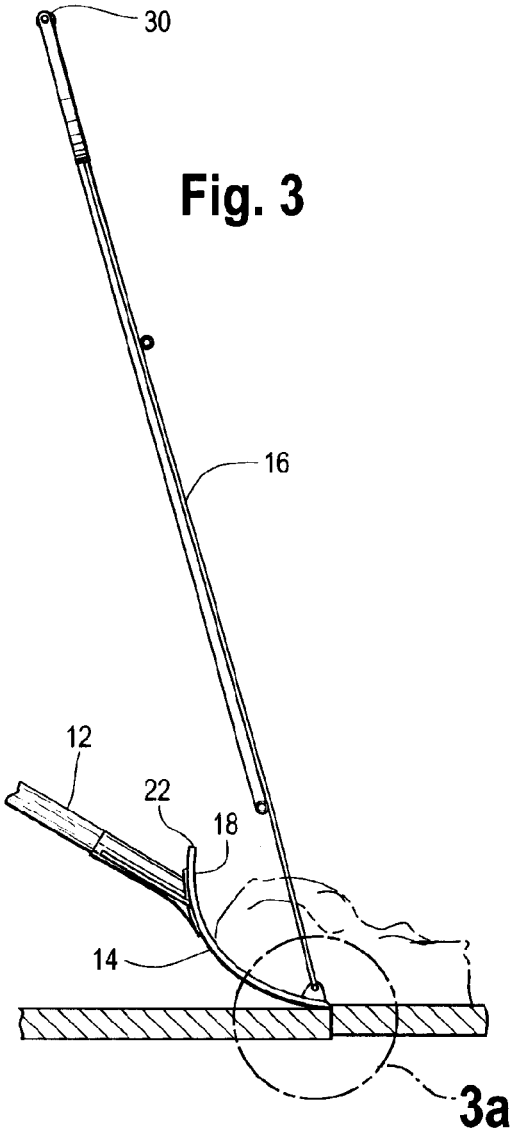
Fig. 3
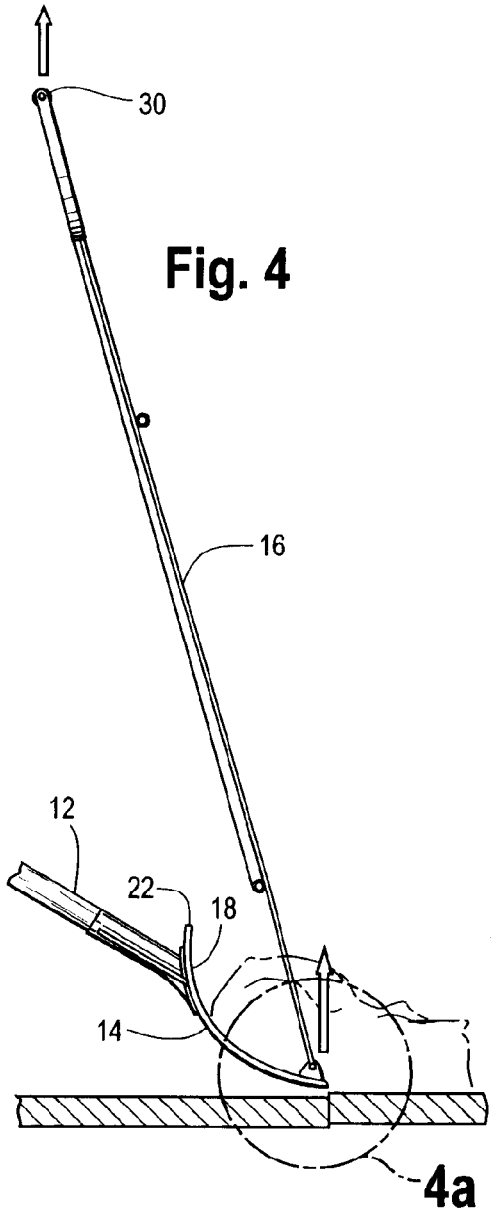
Fig. 4
Fig. 3a
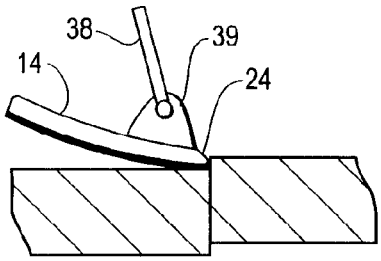
Fig. 4a
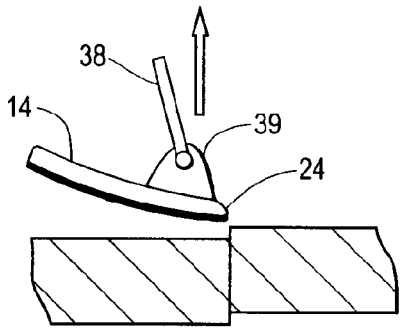

TWO HANDLED SHOVEL

BACKGROUND OF INVENTION

This patent relates to a shovel such as that used to clear snow from a driveway or walkway. More particularly, this patent relates to a shovel having a second handle pivotally connected to the shovel blade.

Numerous shovels have been designed to make easier the task of clearing snow or other heavy debris from a driveway or other surface. A small number of these shovels include a second handle or lever. For example, the shovel described in Evertsen U.S. Pat. No. 4,881,332 has a second elongate stem pivotally attached to the shovel handle. To facilitate unloading the shovel blade, the elongate stem may be freely rotatable about the shovel handle.

The shovel described in Revoldt U.S. Pat. No. 5,411,305 has a second, shorter handle pivotally mounted on the main handle adjacent the blade.

Sims U.S. Pat. No. 5,704,672 describes a snow shovel having an auxiliary handle tethered to the shovel blade near the base of the main handle stem by means of a resilient bungee cord. The auxiliary handle is used to help lift the blade and unload the snow.

Champi U.S. Pat. No. 5,732,933 describes a snow shovel having a lever pivotally attached the main handle. The lever may be operated by the user's foot to relieve strain on the upper body and back during lifting.

While these and other shovels described in the literature may be suitable for their particular purposes, their remains a need for an improved shovel that can be used to remove show, dirt, gravel and other heavy debris from driveways, walkways and other surfaces, particularly those having surface discontinuities and impediments that can cause the shovel to stop abruptly.

Thus it is an object of the present invention to provide a shovel having a second handle to assist the user in removing show, dirt, gravel and other heavy debris from driveways, walkways and other surfaces, particularly those having surface discontinuities and impediments.

Another object of the invention is to provide a shovel having a blade that can be flipped with the aid of a second handle.

Yet another object of the invention is to provide shovel that can be used to pull snow or other debris toward the user.

Yet another object of the invention is to provide a shovel that can be used by two persons in tandem.

Further and additional objects will appear from the description, accompanying drawings, and appended claims.

SUMMARY OF INVENTION

The present invention is a two handled shovel for clearing a surface of snow, dirt, gravel or other debris, the shovel comprising a blade having a leading edge which contacts the surface, a main handle attached to the blade and an auxiliary handle pivotally attached to the blade near the leading edge. To use the shovel, the user holds the main and auxiliary handles and pushes the shovel forward to scoop up the snow or debris. To dump the snow or debris collected in the blade off to the side, the user can pivot the blade on a point at either end of the leading edge by manipulating the main and auxiliary handles.

The shovel is particularly suited for use on surfaces having discontinuities or other impediments that can catch the leading edge of the blade and abruptly stop the forward movement of the shovel. If the blade encounters a surface discontinuity or other impediment, the user can lift the leading edge of the blade over the impediment by lifting on the auxiliary handle. The user can also minimize or avoid abrupt stops caused by ribbed or otherwise textured surfaces by continually lifting the blade slightly off the surface using the auxiliary handle.

The shovel may also be used by two persons simultaneously, with one user pushing the blade with the main handle while a second user pulls the blade with the auxiliary handle.

BRIEF DESCRIPTION OF DRAWINGS

FIG. 3 is a side elevational view of the shovel of FIG. 1.

FIG. 3A is a close up view of the shovel of FIG. 3.

FIG. 4 is a side elevational view of the shovel of FIG. 1 shown being lifted over the broken edge of a surface.

FIG. 4A is a close up view of the shovel of FIG. 4.

DETAILED DESCRIPTION

Figure 1:
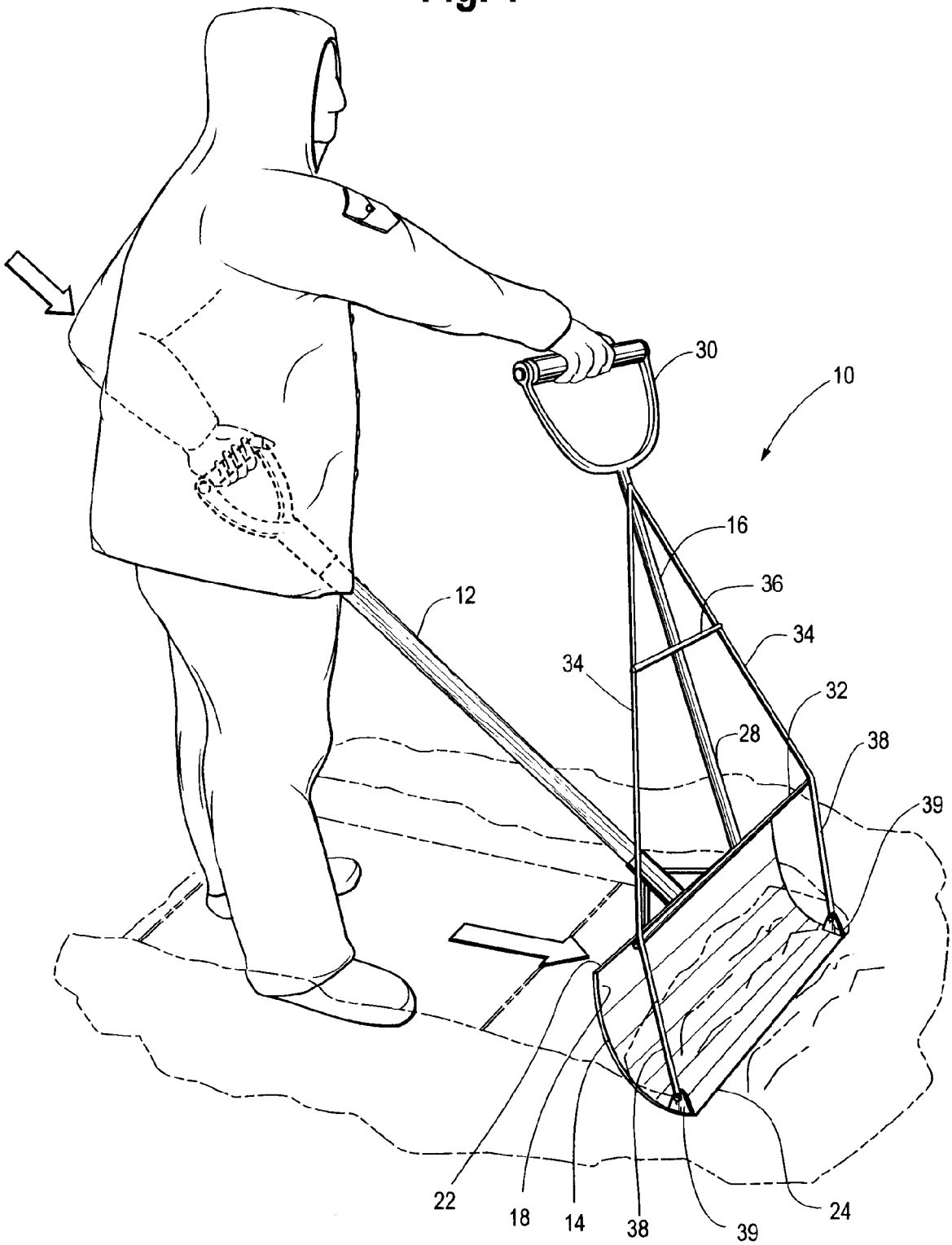
FIG. 1 is a perspective view of the shovel of the present invention shown as is might be used to clear snow by a single user.

Turning to the drawings, there is shown in FIG. 1 the preferred embodiment of the present invention, a shovel 10 for clearing snow, dirt, gravel or other debris from a driveway, walkway or other surface. The shovel, shown being used to clear snow from a surface, comprises an elongated handle 12 attached to a blade or scoop 14 in conventional fashion, and a second, auxiliary handle 16 pivotally attached to the blade 14.

The shovel blade 14 is conventional in design and may be curved, flat, or any suitable shape. The blade 14 may also be pointed like a spade for digging purposes. Preferably the blade 14 is curved and rectangular as shown in the figures. The blade 14 comprises a front, forward facing (concave) surface 18, a rear (convex) surface 20, a top edge 22 and a bottom (leading) edge 24 that typically contacts the surface being cleared.

The main handle 12 preferably is attached to the rear surface 20 of the blade 14 near the top edge 22 as best shown in FIGS. 3 and 4, although other attachment configurations are contemplated, including that disclosed in U.S. Pat. No. 6,497,439, incorporated herein by reference. A cross-handle 26 may be attached to the top (user) end of the handle 12 for ease of use.

The auxiliary handle 16 is pivotally attached to the blade 14, preferably near the leading edge 24 so that the auxiliary handle 16 can pivot approximately about an axis defined by the leading edge 24. In the illustrated embodiment, the auxiliary handle comprises a central elongate stem 28 extending downward from a cross-handle 30 to a rigid horizontal member 32. Two diagonal struts 34 extend obliquely from the central stem 28 near the cross-handle 30 to opposing ends of the horizontal member 32 such that the diagonal struts 34 and horizontal member 32 form a triangular frame. A second, shorter horizontal member 36 connects the diagonal struts 34 along an axis intermediate the cross-handle 30 and first horizontal member 32 to increase the rigidity of the triangular frame. Two substantially parallel side members 38 extend downward from the diagonal struts 34 and are pivotally attached to side lugs 39 located near either end of the blade leading edge 24. The auxiliary handle 16 may be detachable for more compact storage.

Figure 6:
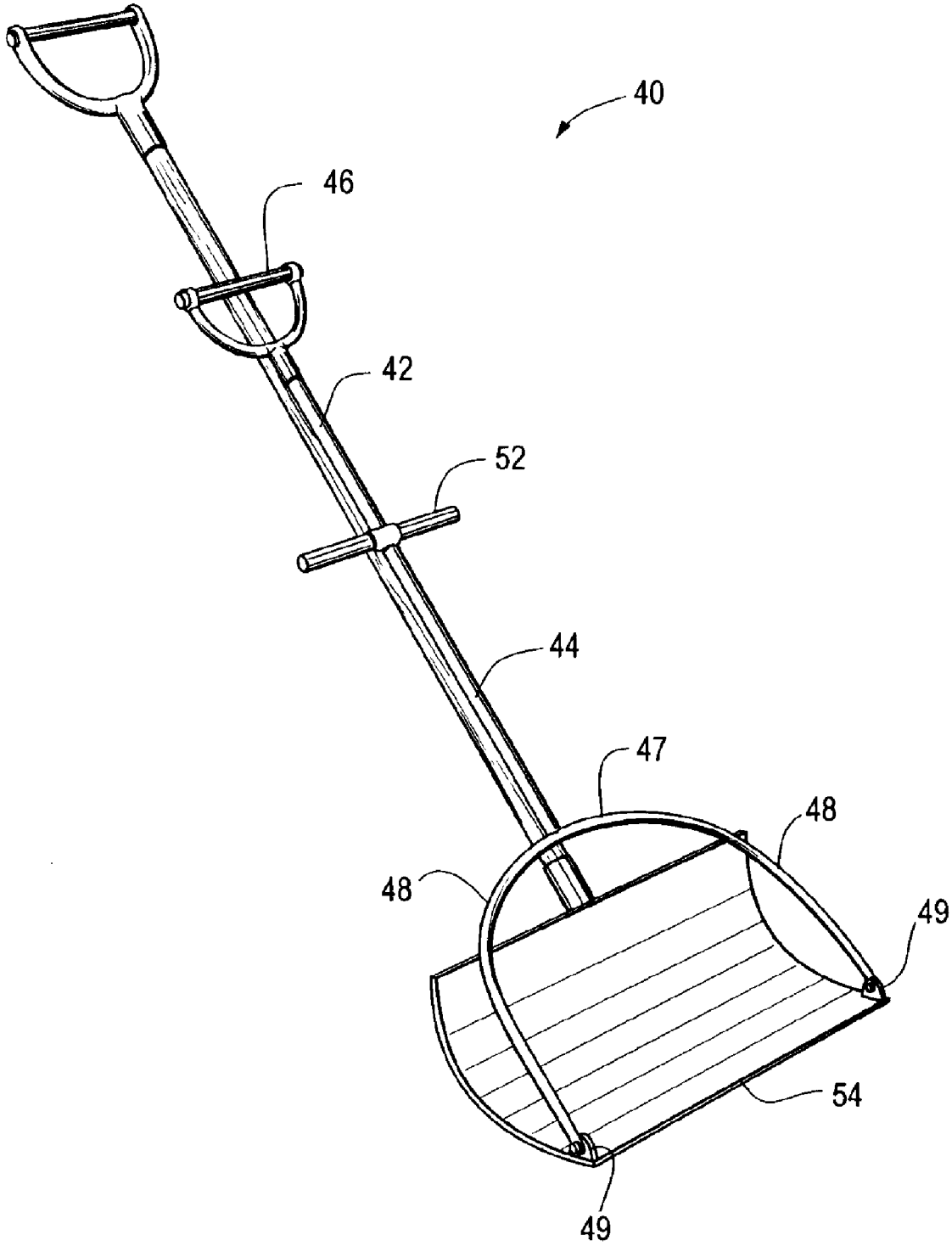
FIG. 6 is a perspective view of an alternative embodiment of the invention.

It should be understood that the auxiliary handle 16 can take many other forms that do not depart from the scope of the invention as described and claimed herein as long as the auxiliary handle is pivotally attached to the blade 14. FIG. 6 shows one such alternative embodiment of the invention wherein the auxiliary handle 42 comprises an elongate stem 44 extending from a cross-handle 46 to a substantially U-shaped or V-shaped fork 47. The fork 47 comprises arms 48 that, like the side members 38 of the preferred embodiment 10, extend downward and are pivotally attached to side lugs 49 located near either end of the blade leading edge 54. An optional cross-bar 52 may be mounted on the stem 44 intermediate the cross-handle 46 and the fork 47 to provide an additional place for the user to hold the auxiliary handle 44.

Figure 2:
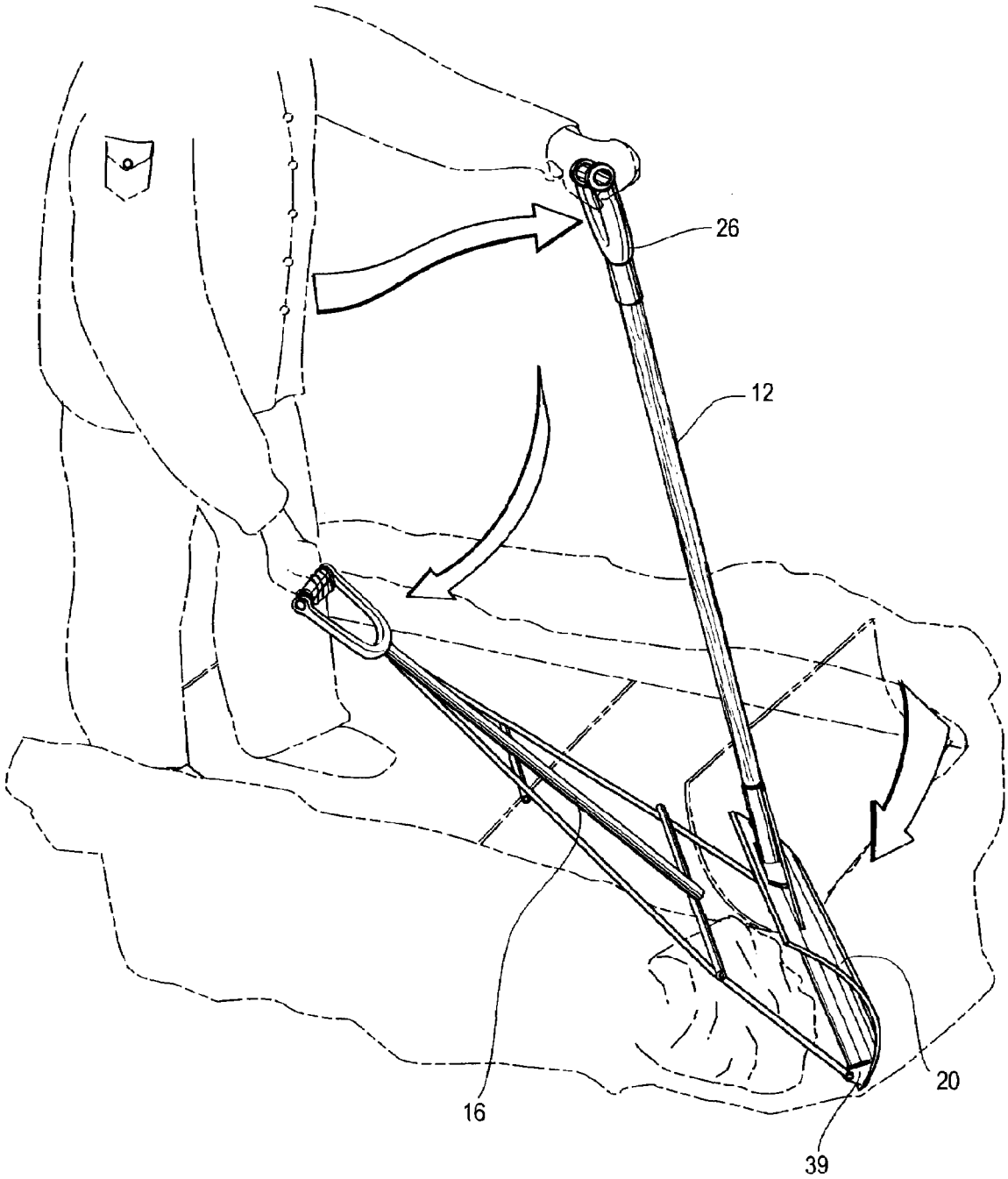
FIG. 2 is a perspective view of a user dumping snow from the shovel of FIG. 1 by pivoting the shovel blade about a corner of the blade.

The invention may be used to clear snow from a surface in the following manner. As shown in FIG. 1, the user holds the main and auxiliary handles 12, 16 in both hands and pushes the shovel forward to collect snow in the blade 14. Next, as shown in FIG. 2, the snow may be dumped to the side by flipping the blade 14 about a point at either end of the leading edge 24 with the aid of the main and auxiliary handles 12, 16.

The present invention is particularly suited for use on surfaces having discontinuities or other impediments that can catch the leading edge 24 of the blade 14 and abruptly stop the forward movement of the shovel 10. As shown in FIGS. 3 and 4, if the blade 14 encounters a surface discontinuity or other impediment, the user can lift the leading edge 24 of the blade 14 over the impediment by lifting on the auxiliary handle 16. The user can also minimize or avoid abrupt stops caused by ribbed or otherwise textured surfaces by continually lifting the blade 14 slightly off the surface using the auxiliary handle 16.

The present invention may also be used to pull snow and debris toward the user with the aid of the auxiliary handle 16. To accomplish this task, the user inverts the shovel 10 so that the concave side 18 of the blade 14 faces down and pulls the blade 14 toward him with the auxiliary handle 16 while using the main handle 12 to stabilize the shovel 10.

Figure 5:
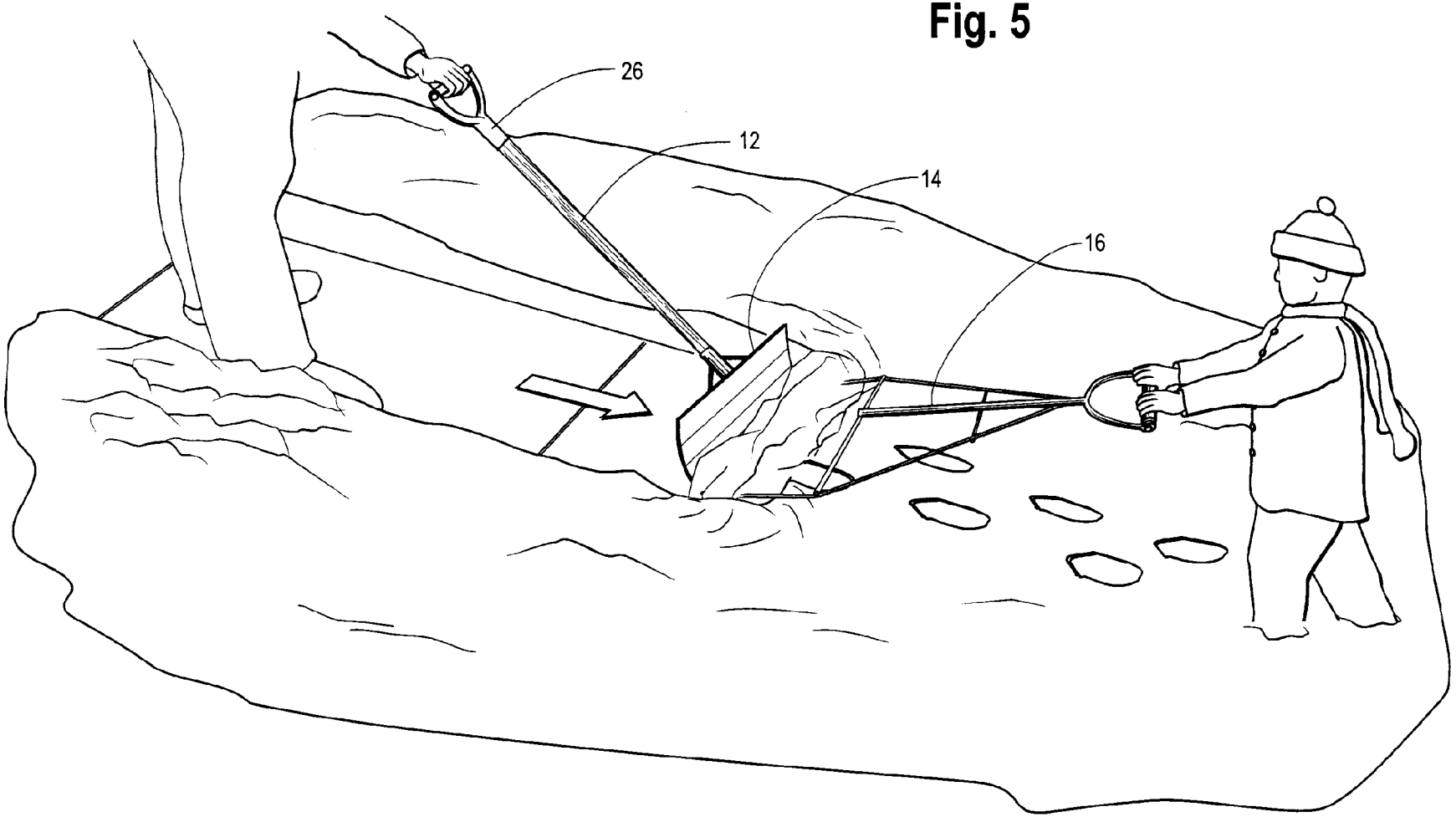
FIG. 5 is a perspective view of the shovel of FIG. 1 shown being used by two persons.

The present invention may also be used by two persons simultaneously, as shown in FIG. 5. One user pushes the blade 14 with the main handle 12 while a second user pulls the blade 14 using the auxiliary handle 16. In this application, the auxiliary handle 16 is pivoted forward a plane normal to the surface being cleared.

Other modifications and alternative embodiments of the invention are contemplated which do not depart from the scope of the invention as defined by the foregoing teachings and appended claims. It is intended that the claims cover all such modifications that fall within their scope.

The invention claimed is:

1. A two handled shovel for clearing a surface, the shovel comprising:

a blade having a concave, forward-facing surface, a rear edge and a straight leading edge which contacts the surface;

a main handle fixedly attached to the blade near the rear edge; and an auxiliary handle comprising a central stem extending from a free end to a first horizontal member, two diagonal struts extending from the central stem to opposing ends of the first horizontal member, and two side members extending from the diagonal struts and pivotally attached to side lugs located at either end of the blade leading edge.

2. The shovel of claim 1 further comprising a second horizontal member connecting the diagonal struts along an axis intermediate the first horizontal member and the free end of the stem.

* * * * *